US006594457B2

(12) United States Patent
Tsutsumi et al.

(10) Patent No.: US 6,594,457 B2
(45) Date of Patent: Jul. 15, 2003

(54) BRUSH ROLL CLEANING UNIT AND IMAGE FORMATION APPARATUS USING IT

(75) Inventors: Yasuyuki Tsutsumi, Iwatsuki (JP); Shigeki Nishimura, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/109,861

(22) Filed: Apr. 1, 2002

(65) Prior Publication Data

US 2002/0146260 A1 Oct. 10, 2002

(30) Foreign Application Priority Data

Apr. 4, 2001 (JP) ..... 2001-106292

(51) Int. Cl.[7] ..... G03G 21/00

(52) U.S. Cl. ..... 399/101; 399/353; 399/354; 15/256.52

(58) Field of Search ..... 399/353, 354, 399/355; 430/125; 15/160, 179, 182, 256.52

(56) References Cited

U.S. PATENT DOCUMENTS 4,005,512 A * 2/1977 Kandel ..... 15/160

6,381,427 B1 * 4/2002 Bertram et al. ..... 399/101

FOREIGN PATENT DOCUMENTS

| | | |
|---|---|---|
| JP | A 5-297771 | 11/1993 |
| JP | A 7-104562 | 4/1995 |
| JP | A 11-149202 | 6/1999 |

* cited by examiner

*Primary Examiner*—Joan Pendegrass
(74) *Attorney, Agent, or Firm*—Oliff & Berridge, PLC

(57) ABSTRACT

A cleaning unit having a brush roll with a myriad of slidingly scrubbing bristles upright relative to a rotation shaft for slidingly scrubbing the surface of a rotation body with the brush roll for removing toner deposited on the rotation body. When the brush roll is out of contact with the rotation body, the tips of the slidingly scrubbing bristles are inclined in the circumferential direction and when the brush roll is placed in contact with the rotation body, the brush roll does not rotate by itself and is rotated with rotation of the rotation body. The linear speed of the brush roll at the contact position is made different from that of the rotation body.

7 Claims, 3 Drawing Sheets

BRUSH ROLL CLEANING UNIT AND IMAGE FORMATION APPARATUS USING IT

The present disclosure relates to the subject matter contained in Japanese Patent Application No. 2001-106292 filed Apr. 4, 2001, which is incorporated herein by reference in its entirety.

BACKGROUND OF THE INVENTION

1. Field of the Invention

This invention relates to a cleaning unit for removing remaining toner, paper powder, etc., from the surfaces of a photoconductor drum, an intermediate transfer body, and the like after a toner image is transferred to record paper in an image formation apparatus such as an electrophotographic copier or a laser beam printer and more particularly to improvements for miniaturizing an image formation apparatus and saving energy.

2. Description of the Related Art

Generally, an image formation apparatus such as an electrophotographic copier or a laser beam printer forms a toner image on the surface of a photoconductor drum in response to image data and then transfers the toner image to a record sheet and fuses the transferred toner image on the record sheet, thereby providing a record image. It has also been known that some recent full color copiers or full color laser beam printers primarily transfer a toner image formed on a photoconductor drum to an intermediate transfer body, superpose four color toner images of yellow, cyan, magenta, and black on the intermediate transfer body, and secondarily transfer the resultant toner image to a record sheet in batch, thereby forming a full color record image.

Since the toner image transfer efficiency is affected by fluctuations of the resistance values of the record sheet and the intermediate transfer body accompanying change in the surface state, temperature, or humidity of each of the photoconductor drum and the intermediate transfer body, it is difficult to maintain the toner image transfer efficiency 100%, and the remaining toner is deposited on the surfaces of the photoconductor drum and the intermediate transfer body of the toner image transfer sources still after the toner image is transferred. Thus, hitherto, an image carrying body such as the photoconductor drum or the intermediate transfer body has been provided with a cleaning unit downstream from the toner image transfer part for removing the remaining toner on the image carrying body before another toner image is formed.

As such a cleaning unit, a unit for pressing an elastic rubber blade against the surface of a photoconductor body and removing the remaining toner by a mechanical force is used widely. The blade-type cleaning unit has the advantages that it is mechanically simple and is at low cost because it does not require a drive section. However, the rubber blade not only removes the remaining toner, but also shaves little by little the surface of the image carrying body to be cleaned and thus the blade-type cleaning unit has the disadvantage that damage to the photoconductive layer, etc., of the photoconductor drum is large, shortening the life of the photoconductor drum. Particularly, in recent years, making small the diameter of the photoconductor drum has been noticeable from the viewpoint of miniaturization and there has also been a trend toward an increase in the number of revolutions of the photoconductor drum for the same number of print sheets. Thus, with the blade-type cleaning unit, the life of the photoconductor drum would be shortened more and more.

On the other hand, known as any other cleaning unit than the blade-type cleaning unit is a fur brush cleaning unit for bringing a brush roll with a myriad of slidingly scrubbing bristles planted into contact with an image carrying body and rotating the brush roll at high speed, thereby mechanically removing the remaining toner. Such a brush roll is rotated by a motor and the toner capture efficiency can be raised by setting large the linear speed ratio of the brush roll to the image carrying body to be cleaned. With the fur brush cleaning unit, as compared with the blade-type cleaning unit, damage to the image carrying body is small and it can be expected that the life of the photoconductor drum will be prolonged accordingly. However, to rotate the brush roll, a motor and a gear train become necessary and the configuration of the cleaning unit must be enlarged.

In recent years, miniaturization of image formation apparatus has been advancing remarkably and making small the diameter of the image carrying body such as the photoconductor drum or the intermediate transfer body has been noticeable. Thus, it is desirable that the cleaning unit should be easy on the surface of the image carrying body and should make it possible to prolong the life of the image carrying body. From the viewpoints of miniaturization and energy saving of image formation apparatus, a cleaning unit not requiring drive means of a motor, etc., is desired. Particularly, the need for such a cleaning unit is large with a tandem-type full color copier or full color printer comprising photoconductor drums in a one-to-one correspondence with toner colors.

It is therefore an object of the invention to provide a cleaning unit that can exert sufficient toner capture performance without having a drive mechanism such as a motor, can contribute to miniaturization and cost reduction of an image formation apparatus, and makes it possible to lessen damage to an image carrying body for prolonging the life of the image carrying body.

SUMMARY OF THE INVENTION

From the viewpoint of lessening the stress that a rotation body such as a photoconductor drum or an intermediate transfer body receives as a brush roll slidingly scrubs the rotation body, it may be possible to allow the brush roll to rotate simply to follow rotation of the rotation body without rotating the brush roll by a drive source such as a motor. If the brush roll is thus rotated with rotation of the rotation body, slidingly scrubbing the surface layer of the rotation body by an external force of a motor, etc., is avoided and thus damage to the surface layer can be prevented as much as possible and it can be expected that the life of the rotation body will be prolonged. Since the motor and gear train for driving the brush roll become unnecessary, the structure becomes simple and compact and the manufacturing cost can also be reduced.

However, to efficiently capture the toner deposited on the rotation body in the brush roll, the shearing force for moving the toner from the surface of the rotation body is required. As the brush roll is allowed simply to rotate with rotation of the rotation body, the linear speed of the brush roll and that of the rotation body become roughly the same at the contact position between the brush roll and the rotation body and thus a sufficient shearing force cannot be made to act on the toner.

Then, in the invention, the tips of slidingly scrubbing bristles of the brush roll for slidingly scrubbing the rotation body are inclined in the circumferential direction, whereby the linear speed of the brush roll rotated with rotation of the rotation body is controlled aggressively.

According to the invention, there is provided a cleaning unit having a brush roll having a large number of slidingly scrubbing bristles upright in relation to a rotation shaft thereof, the brush for slidingly scrubbing a surface of a rotation body with the brush roll to remove a toner deposited on the rotation body. When the brush roll is out of contact with the rotation body, tips of the slidingly scrubbing bristles are inclined in a circumferential direction thereof. When the brush roll is in contact with the rotation body, the brush roll does not drive to rotate itself and is rotated to follow rotation of the rotation body. The linear speed of the brush roll at a contact position between the brush roll and the rotation body is different from that of the rotation body at the contact position.

According to the technical means, when the brush roll is not contact with the rotation body, the tips of the slidingly scrubbing bristles are inclined in the circumferential direction. Thus, if the brush roll is placed in contact with the rotation body and the rotation body is rotated, it is made possible to control as desired to some extent the linear speed of the brush roll rotated with rotation of the rotation body in response to the inclination direction, the inclination angle, the length, the hardness, etc., of the slidingly scrubbing bristles, and the linear speed of the brush roll can be made different from that of the rotation body. Consequently, the shearing force can be made to act on the toner deposited on the rotation body and it is made possible even for the brush roll rotated simply with rotation of the rotation body to capture the toner efficiently.

If the outer diameter of the brush roll is the same, the length of the slidingly scrubbing bristles can be set longer as the tips of the slidingly scrubbing bristles are inclined, so that it is also made possible to increase the amount of toner that can captured and held in the brush roll.

In the invention, the tips of the slidingly scrubbing bristles of the brush roll may be inclined in any circumferential direction. To incline the tips of the slidingly scrubbing bristles along the rotation direction of the rotation body, the peripheral speed of the brush roll tends to become lower than the peripheral speed of the rotation body; to incline the tips of the slidingly scrubbing bristles in the opposite direction to the rotation direction of the rotation body, the peripheral speed of the brush roll tends to become higher than the peripheral speed of the rotation body.

The inventors recognized that if the linear speed ratio of the brush roll to the rotation body is 0.6 or less or 1.3 or more, the toner deposited on the rotation body can be captured effectively and the remaining toner deposited on the rotation body does not adversely affect the image formation operation.

The outer diameter of the brush roll, the length and the hardness of the slidingly scrubbing bristles, and the surface hardness and the surface roughness of the rotation body can be named as factors affecting the rotation speed of the brush roll rotated with rotation of the rotation body. These are selected appropriately, whereby the linear speed ratio of the brush roll to the rotation body can be adjusted as desired.

Only the tips of the slidingly scrubbing bristles may be inclined in the circumferential direction of the brush roll, but may be made upright in relation to the rotation shaft in an inclined state from the root. In the former case, the brush roll can be manufactured by making slidingly scrubbing bristles upright roughly perpendicularly in relation to the periphery of a rotation shaft and then laying down only the tips of the slidingly scrubbing bristles in a specific direction while heat is applied. On the other hand, in the latter case, the brush roll can be manufactured by winding a cloth with slidingly scrubbing bristles upright in an inclined state around a rotation shaft.

To capture toner from the rotation body into the brush roll, only the shearing force acting based on the linear speed difference between the rotation body and the brush roll may be used. However, the brush roll may be made up of a conductive rotation shaft and slidingly scrubbing bristles and a cleaning bias may be applied between the brush roll and the rotation body. In doing so, the toner deposited on the rotation body can be captured in the brush roll more effectively. The voltage polarity of the cleaning bias may be selected appropriately in response to the charge polarity of the toner to be captured. For example, if toner charged to the negative polarity is used to form a toner image, the toner of the negative polarity remains on the photoconductor drum and the intermediate transfer body after the toner image is transferred. The cleaning bias of the positive polarity is applied to the brush roll, whereby the remaining toner can be captured. Some remaining toner is reversed to the positive polarity by a transfer current. Thus, if the toner reversed in polarity is captured, the cleaning bias of the negative polarity is applied to the brush roll. The inventors recognized that if the cleaning bias is applied to the brush roll, the linear speed of the brush roll tends to rise 5%.

The photoconductor drum, the intermediate transfer drum as described above, a photoconductor belt, and an intermediate transfer belt can be named as the rotation bodies to which the cleaning unit of the invention is applied. In recent years, a transfer roll to which a transfer bias is applied has been used to transfer a toner image to a record sheet; toner from a photoconductor drum or an intermediate transfer drum also tends to be deposited on the transfer roll. Therefore, the cleaning unit of the invention can also be applied to the transfer roll.

BRIEF DESCRIPTION OF THE DRAWINGS

Exemplary embodiments are described below based on the drawings, in which like numerals represent like parts, and wherein.

DETAILED DESCRIPTION OF THE PREFERRED EMBODIMENTS

Referring now to the accompanying drawings, cleaning units of the invention will be discussed in detail.

Figure 1:
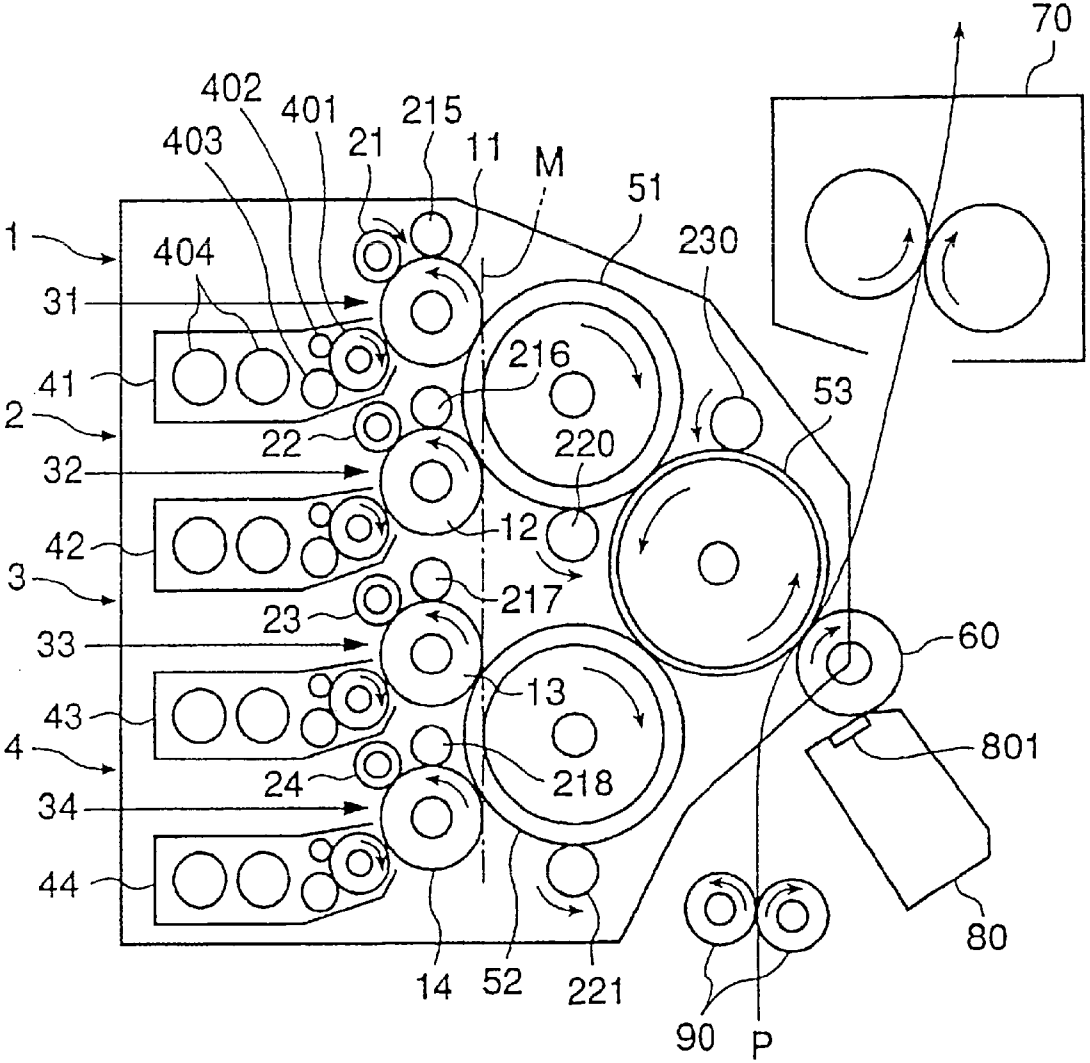
FIG. 1 is a schematic drawing to show the configuration of a color laser beam printer incorporating cleaning units of the invention.

FIG. 1 shows a full color laser beam printer comprising the cleaning units of the invention. In the figure, arrows indicate the rotation directions of rotation members.

The full color printer comprises the main section made up of image formation units 1, 2, 3, and 4 having photoconductor drums 11, 12, 13, and 14 for cyan (C), magenta (M), Yellow (Y), and black (K), charging rolls 21, 22, 23, and 24 for primary charging for coming in contact with the photoconductor drums 11, 12, 13, and 14, a laser optical unit (not shown) for applying cyan (C) laser light 31, magenta (M) laser light 32, yellow (Y) laser light 33, and black (K) laser light 34, developing units 41, 42, 43, and 44, a first primary intermediate transfer drum 51 for coming in contact with the two photoconductor drums 11 and 12, a second primary intermediate transfer drum 52 for coming in contact with the two photoconductor drums 13 and 14, a secondary intermediate transfer drum 53 for coming in contact with the first and second primary intermediate transfer drums 51 and 52, and a final transfer roll 60 for coming in contact with the secondary intermediate transfer drum 53.

The photoconductor drums 11, 12, 13, and 14 are placed with a constant spacing so as to have a common contact plane M. The first primary intermediate transfer drum 51 and the second primary intermediate transfer drum 52 are placed so that their rotation shafts are parallel with the shafts of the photoconductor drums 11, 12, 13, and 14 and are symmetrical with respect to a plane with a predetermined symmetrical plane as the boundary. Further, the secondary intermediate transfer drum 53 is placed so that its rotation shift is parallel with the photoconductor drums 11, 12, 13, and 14.

A signal responsive to image information for each color is rasterized by an image processing unit (not shown) and is input to the laser optical unit (not shown), which then modulates cyan (C) laser light 31, magenta (M) laser light 32, yellow (Y) laser light 33, and black (K) laser light 34, and applies them to the corresponding color photoconductor drums 11, 12, 13, and 14.

A known electrophotographic image formation process for each color is executed in the surroundings of the photoconductor drums 11, 12, 13, and 14. To begin with, a photoconductor drum using an OPC photoconductor measuring 20 mm in diameter is used as each of the photoconductor drums 11, 12, 13, and 14 and the photoconductor drums 11, 12, 13, and 14 are rotated at a rotation speed of 95 mm/sec. The surfaces of the photoconductor drums 11, 12, 13, and 14 are uniformly charged to about −300 V, for example, as about −800 VDC voltage is applied to the charging rolls 21, 22, 23, and 24, as shown in FIG. 1. In the embodiment, only the DC component is applied to the charging rolls, but an AC component can also be superposed on the DC component.

The laser optical unit as a light exposure unit applies the laser light 31, the laser light 32, the laser light 33, and the laser light 34 corresponding to cyan (C), magenta (M), yellow (Y), and black (K) respectively to the surfaces of the photoconductor drums 11, 12, 13, and 14 each thus comprising a uniform surface potential for forming electrostatic latent images responsive to the input image information for each color. As the laser optical unit writes the electrostatic latent images, the surface potential of each of image exposure parts on the photoconductor drums 11, 12, 13, and 14 is eliminated to about −60 V or less.

The electrostatic latent images corresponding to cyan (C), magenta (M), yellow (Y), and black (K) formed on the surfaces of the photoconductor drums 11, 12, 13, and 14 are developed by the corresponding color developing units 41, 42, 43, and 44 and are rendered visible as cyan (C), magenta (M), yellow (Y), and black (K) toner images on the photoconductor drums 11, 12, 13, and 14. The developing units 41, 42, 43, and 44 are filled with developers consisting of cyan (C), magenta (M), yellow (Y), and black (K) toners and carriers. When toner is supplied to the developing unit 41, 42, 43, 44 from a toner replenishment unit (not shown), the supplied toner is sufficiently agitated together with carrier and is frictionally charged by an auger 404. A magnet roll (not shown) comprising a plurality of magnetic poles placed at predetermined angle is placed in the developing roll 401 in a fixed state. The developer transported to the proximity of the surface of the developing roll 401 by a paddle 403 for transporting the developer to the developing roll 401 is regulated in amount transported to the developing part by a developer amount regulation member 402. In the embodiment, the amount of the developer is 30 to 50 g/m$^2$ and at this time, the charge amount of the toner existing on the developing roll 401 is about −20 to −35 $\mu$C/g.

The toner supplied to the top of the developing roll 401 is like a magnetic brush made up of carrier and toner by the magnetic force of the magnetic roll and the magnetic brush is in contact with the photoconductor drum 11, 12, 13, 14. A developing bias voltage of AC+DC is applied to the developing roll 401 for developing the toner on the developing roll 401 to an electrostatic latent image formed on the photoconductor drum 11, 12, 13, 14, whereby a toner image is formed. In the embodiment, as the developing bias voltage, AC is about 4 kHz, 1.5 kVpp and DC is about −230 V.

Next, the cyan (C), magenta (M), yellow (Y), and black (K) toner images formed on the photoconductor drums 11, 12, 13, and 14 are electrostatically primarily transferred onto the first primary intermediate transfer drum 51 and the second primary intermediate transfer drum 52. The cyan (C) and magenta (M) toner images formed on the photoconductor drums 11 and 12 are transferred onto the first primary intermediate transfer drum 51, and the yellow (Y) and black (K) toner images formed on the photoconductor drums 13 and 14 are transferred onto the second primary intermediate transfer drum 52. Therefore, a single-color image transferred from either the photoconductor drum 11 or 12 and a double color image provided by superposing two color toner images transferred from both the photoconductor drums 11 and 12 are formed on the first primary intermediate transfer drum 51. Likewise, a single-color image transferred from either the photoconductor drum 13 or 14 and a double color image provided by superposing two color toner images transferred from both the photoconductor drums 13 and 14 are formed on the second primary intermediate transfer drum 52.

The surface potential required for electrostatically transferring a toner image from the photoconductor drum 11, 12, 13, 14 onto the first, second primary intermediate transfer drum 51, 52 is about +250 to 500 V. Although the optimum surface potential fluctuates with the toner charge state and the ambient temperature and humidity, if the toner charge amount is in the range of −20 to −35 $\mu$C/g and the apparatus is in the normal temperature and humidity environment, it is desirable that the surface potential of each of the first and second primary intermediate transfer drums 51 and 52 should be about +380 V. The first, second primary intermediate transfer drum 51, 52 has a diameter of 42 mm and a resistance value set to about $10^8\Omega$ and is formed by coating a metal pipe of Fe, Al, etc., with a low-resistance elastic layer ($R=10^2\Omega$ to $10^3\Omega$) of conductive silicone rubber, etc. Further, a fluoro rubber layer 3 to 100 $\mu$m thick is placed on the surface of the low-resistance elastic layer as a high release layer and is bonded with an adhesive (primer) of a silane coupling agent family. The high release layer has a resistance value of about $R=10^5\Omega$ to $10^9\Omega$.

Then, the single-color or double-color toner image formed on each of the first and second primary intermediate transfer drums 51 and 52 is electrostatically secondarily transferred onto the secondary intermediate transfer drum 53. Therefore, the final toner image from the single-color image to four-color image of cyan (C), magenta (M), yellow (Y), and black (K) is formed on the secondary intermediate transfer drum 53.

The surface potential required for electrostatically transferring a toner image from each of the first and second primary intermediate transfer drums 51 and 52 onto the secondary intermediate transfer drum 53 is about +600 to 1200 V. The optimum surface potential fluctuates with the toner charge state and the ambient temperature and humidity as in the primary transfer mode. Since the potential difference between the first, second primary intermediate transfer drum 51, 52 and the secondary intermediate transfer drum 53 is required for transferring, it is necessary to set to a value responsive to the surface potential of the first, second primary intermediate transfer drum 51, 52. If the toner charge amount is in the range of −20 to −35 $\mu$C/g and the apparatus is in the normal temperature and humidity environment and the surface potential of each of the first and second primary intermediate transfer drums 51 and 52 is about +380 V as described above, it is desirable that the surface potential of the secondary intermediate transfer drum 53 should be set to about +880 V, namely, the potential difference between the first, second primary intermediate transfer drum 51, 52 and the secondary intermediate transfer drum 53 should be set to about +500 V.

The secondary intermediate transfer drum 53 used in the embodiment has a diameter of 42 mm like the diameter of the first, second primary intermediate transfer drum 51, 52 and a resistance value set to about $10^{11}\Omega$. Like the primary intermediate transfer drum, the secondary intermediate transfer drum 53 is also formed by coating a metal pipe of Fe, Al, etc., with a low-resistance elastic layer ($R=10^2\Omega$ to $10^3\Omega$) of conductive silicone rubber, etc., about 0.1 to 10 mm thick, and the surface of the low-resistance elastic layer is coated with a high release layer made of fluoro rubber 3 to 100 $\mu$m thick. Here, the resistance value of the secondary intermediate transfer drum 53 needs to be set higher than that of the first, second primary intermediate transfer drum 51, 52; otherwise, the secondary intermediate transfer drum 53 charges the first, second primary intermediate transfer drum 51, 52 and it becomes difficult to control the surface potential of the first, second primary intermediate transfer drum 51, 52.

Last, the final toner image from the single-color image to four-color image formed on the secondary intermediate transfer drum 53 is tertiary-transferred to paper passing through a paper transport passage P by means of a final transfer roll 60. The paper undergoes a paper feed step (not shown), passes through a paper transfer roll 90, and is sent to a nip part between the secondary intermediate transfer drum 53 and the final transfer roll 60. After the final transfer step, the final toner image formed on the paper is fixed by a fuser 70. The image formation process sequence is now complete.

In the laser beam printer of the embodiment thus configured, the cleaning units of the invention are disposed for the photoconductor drums 11, 12, 13, and 14 and the primary intermediate transfer drums 51 and 52. First, the cleaning unit disposed for the photoconductor drum 11 is a first brush roll 215 having conductive, slidingly scrubbing bristles upright on the periphery of a metal rotation shaft. The first brush roll 215 is positioned in an upstream of the charging roll 21 with respect to the rotation direction of the photoconductor drum 11 to prevent toner from being deposited on the charging roll 21. A cleaning bias is applied to the first brush roll 215 for holding the toner until a cleaning mode (described later) is started after the tone reversed in polarity in each transfer part is temporarily collected from the surface of the photoconductor drum 11. That is, the toner is changed to the negative polarity in the developing unit 41 and in each transfer step, the toner image is transferred in the higher potential direction. However, when the toner image passes through the transfer part of each transfer step repeatedly, some of the toner negatively charged may be charged to the opposite polarity, namely, reversed to the positive polarity because of Paschen discharge or charge injection. Such toner reversed in polarity is not transferred to the next step and flows back upstream. Finally, the toner is moved to the photoconductor drum 11 and by extension is deposited on the charging roll 21. The first brush roll 215 is provided for capturing the toner revered in polarity before the charging roll 21 and preventing the toner from being deposited on the charging roll 21. Therefore, when the toner image is formed, −400 V at lower potential than −300 V, which is the surface potential of the photoconductor drum 11, is applied to the first brush roll 215.

Figure 2:
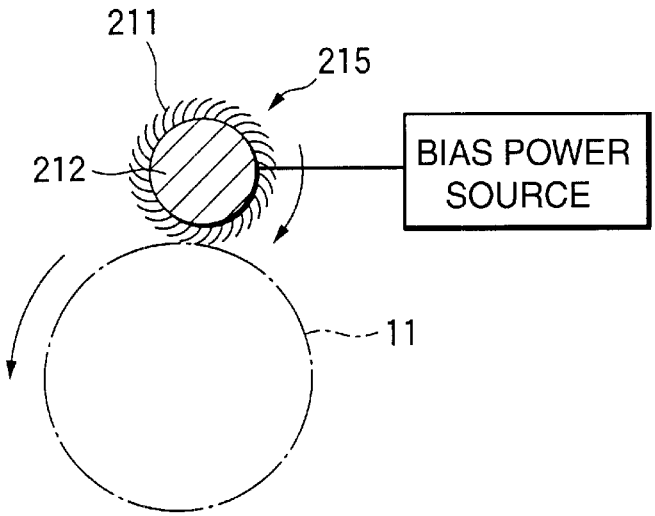
FIG. 2 is a sectional view to show a first brush roll.

The first brush roll 215 is not provided with any drive unit and is rotated to follow rotation of the photoconductor drum 11 by a frictional force acting between the slidingly scrubbing bristles and the photoconductor drum 11. FIG. 2 shows the cross section of the first brush roll 215 brought away from the photoconductor drum 11. The first brush roll 215 has slidingly scrubbing bristles 211, which is not upright roughly perpendicularly to a rotation shaft 212 and is upright inclined in the rotation direction of the photoconductor drum 11. Thus, if the photoconductor drum 11 is rotated with the first brush roll 215 brought into contact with the photoconductor drum 11, a slip occurs between the surface of the photoconductor drum 11 and the slidingly scrubbing bristles 211, making it possible to make the linear speed of the first brush roll 215 at the contact position between the photoconductor drum 11 and the slidingly scrubbing bristles 211 smaller than the linear speed of the photoconductor drum 11. Consequently, not only the electrostatic induction force caused by applying the cleaning bias, but also the shearing force caused by mechanical scrubbing of the first brush roll 215 acts on the toner deposited on the photoconductor drum 11, and the toner can be captured on the first brush roll 215 effectively.

The linear speed of the first brush roll 215 driven by the photoconductor drum 11 can be adjusted as desired by changing the hardness, the planted bristle density, the length, etc., of the slidingly scrubbing bristles. In the embodiment, the outer diameter of the first brush roll 215 is set to about 10 mm, the scrubbing bristle length is set to about 2 mm, the outer diameter of the photoconductor drum 11 is set to about 20 mm, the scrubbing bristle thickness is set to about 3 deniers, the planted bristle density is set to 200000 bristles/square inch, and the penetration amount of the brush outer diameter in the photoconductor drum 11 is set to 0.65 mm or less, whereby the linear speed ratio of the first brush roll 215 to the photoconductor drum 11 can be stabilized to about 0.4.

The first brush roll 215 provided for the photoconductor drum 11 has been described; first brush rolls 216, 217, and 218 having the same structure are also provided for other photoconductor drums 12, 13, and 14.

On the other hand, second brush rolls 220 and 221 each having conductive, slidingly scrubbing bristles upright on the periphery of a metal rotation shaft are disposed for the primary intermediate transfer drums 51 and 52, respectively. The second brush roll 220 is disposed at a position for blocking before the photoconductor drum 12 the remaining toner on the surface of the primary intermediate transfer drum 51 after the termination of secondary transfer and the second brush roll 221 is disposed at a position for blocking before the photoconductor drum 14 the remaining toner on the surface of the primary intermediate transfer drum 52 after the termination of secondary transfer. A cleaning bias is applied to each of the second brush rolls 220 and 221 and has the opposite polarity to that of the cleaning bias applied to the first brush roll 215. Since each photoconductor drum transfers only a single-color toner image to the primary intermediate transfer drum 51, 52 in the primary transfer, the transfer efficiency can be set high to some extent and if a cleaning unit for collecting the remaining toner is not provided, image formation is not largely hindered and color mixing does not occur in the developing unit 41, 42, 43, or 44 either. However, in the secondary transfer, toner images of two colors superposed on each other are transferred to the secondary intermediate transfer drum 53 and thus the toner remaining on the primary intermediate transfer drum 51, 52 without being transferred is much. If the cleaning unit does not collect the remaining toner, a ghost occurs on the next transferred toner image. Thus, a cleaning bias of about +600 V is applied to each of the second brush rolls 220 and 221 disposed for the primary intermediate transfer drums 51 and 52.

Figure 5:
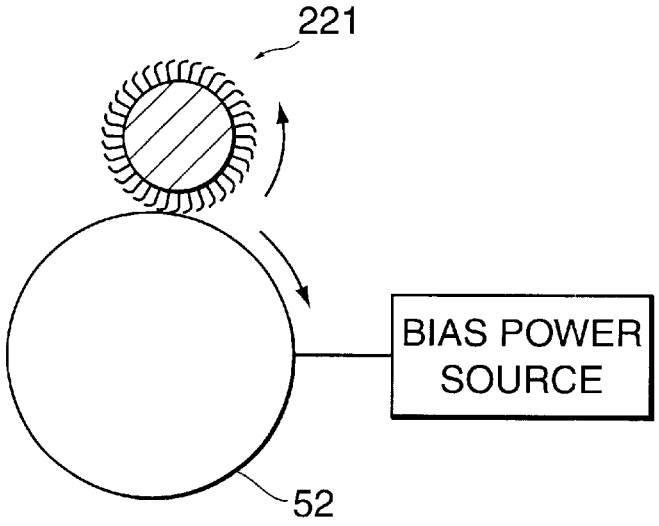
FIG. 5 is a sectional view to show a second brush roll.

The second brush roll 220, 221 is not provided with any drive units either and is rotated to follow rotation of the primary intermediate transfer drum 51, 52 by a frictional force acting between the slidingly scrubbing bristles and the primary intermediate transfer drum 51, 52 like the first brush roll 215. To make the linear speed of the primary intermediate transfer drum 51, 52 different from that of the second brush roll 220, 221, as shown in FIG. 5, the slidingly scrubbing bristles are upright on the rotation shaft to be inclined in an opposite direction to the rotation direction of the primary intermediate transfer drum 51, 52. Thus, if the primary intermediate transfer drum 51, 52 is rotated with the second brush roll 220, 221 brought into contact with the primary intermediate transfer drum 51, 52, it is made possible to make the linear speed of the second brush roll 220, 221 at the contact position between the primary intermediate transfer drum 51, 52 and the second brush roll 220, 221 larger than the linear speed of the primary intermediate transfer drum 51, 52. The reason why the slidingly scrubbing bristles of the second brush roll 220, 221 are thus inclined in the opposite direction to the rotation direction of the primary intermediate transfer drum 51, 52 is that the remaining toner on the primary intermediate transfer drum 51, 52 has strong adhesion and cannot be prevented from causing a ghost image to occur unless the tips of the slidingly scrubbing bristles snap the surface of the primary intermediate transfer drum 51, 52. Accordingly, the toner can be captured on the second brush roll 220, 221 effectively.

In the embodiment, the outer diameter of the second brush roll 220, 221 is set to about 14 mm, the scrubbing bristle length is set to about 4 mm, the outer diameter of the primary intermediate transfer drum 51, 52 is set to about 42 mm, the scrubbing bristle thickness is set to about 6 deniers, the planted bristle density is set to 100000 bristles/square inch, and the penetration amount of the brush outer diameter in the primary intermediate transfer drum 51, 52 is set to 0.5 mm or less, whereby the linear speed ratio of the second brush roll 220, 221 to the primary intermediate transfer drum 51, 52 can be stabilized to about 1.3. The reason why the scrubbing bristle length of the second brush roll 220, 221 is set longer than that of the first brush roll 215 is that the second brush roll 220, 221 for collecting the remaining toner of two colors collects a larger amount of toner than the first brush roll 215.

A third brush roll 230 for removing the remaining toner in the tertiary transfer is also placed for the secondary intermediate transfer drum 53, and is rotated in an opposite direction to the rotation direction of the secondary intermediate transfer drum 53 by a motor (not shown). The reasons why the brush roll 230 is rotated in the opposite direction is that the remaining toner on the secondary intermediate transfer drum 53 is much in the tertiary transfer of transferring toner images of four colors in batch to the record sheet P and even if the cleaning bias is applied, the remaining toner cannot completely be captured as the brush roll 230 is simply driven by the secondary intermediate transfer drum 53.

The first brush rolls 215, 216, 217, and 218, the second brush rolls 220 and 221, and the third brush roll 230 capture toner from the photoconductor drums 11, 12, 13, and 14, the primary intermediate transfer drums 51 and 52, and the secondary intermediate transfer drum 53, respectively, but do not have any mechanism for discharging the captured toner. Therefore, if toner images are formed repeatedly, the captured toner spills over from the slidingly scrubbing bristles of each brush roll. Then, in the printer of the embodiment, to collect the toner captured by each brush roll, the following cleaning operation is performed at one predetermined timing such as before the print operation, after the print operation, or every predetermined number of sheets in the continuous print mode.

In the cleaning operation, first, voltage with a potential gradient is applied in turn to the charging rolls 21, 22, 23, and 24, the first brush rolls 215, 216, 217, and 218, the photoconductor drums 11, 12, 13, and 14, the primary intermediate transfer drums 51 and 52, the secondary intermediate transfer drum 53, and the final transfer roll 60 so that the final transfer roll 60 is set to the highest minus potential, whereby the positively charged toner of opposite polarity collected and held in the first brush rolls 215, 216, 217, and 218 during the print operation is moved in turn up to the final transfer roll 60 and is collected by a final cleaning unit 80 placed in contact with the final transfer roll 60. Therefore, when such cleaning operation is started, the positively charged toner temporarily held in the first brush rolls 215, 216, 217, and 218 is ejected onto the photoconductor drums 11, 12, 13, and 14 and the first brush rolls 215, 216, 217, and 218 is restored to a clean state.

Upon completion of thus cleaning the positively charged toner, the same potential as at the toner image formation time is given to the charging rolls 21, 22, 23, and 24, the photoconductor drums 11, 12, 13, and 14, the primary intermediate transfer drums 51 and 52, the secondary intermediate transfer drum 53, and the final transfer roll 60. On the other hand, a potential of the opposite polarity to that at the image formation time is given to the second and third brush rolls for cleaning the negatively charged toner deposited on the second brush rolls 220 and 221 and the third brush roll 230. That is, the potential of the opposite polarity to that at the image formation time is given to the second brush rolls 220 and 221 and the third brush roll 230, whereby the toner held in the brush rolls is ejected onto the primary intermediate transfer drums 51 and 52 and the secondary intermediate transfer drum 53 and arrives at the final transfer roll 60 via the secondary intermediate transfer drum 53 like the normal toner image transfer, and is collected by the final cleaning unit 80.

The cleaning operation is executed periodically, whereby the toner of any polarity captured in the first, second, and third brush rolls is collected by the final cleaning unit 80 for cleaning the brush rolls.

Figure 3:
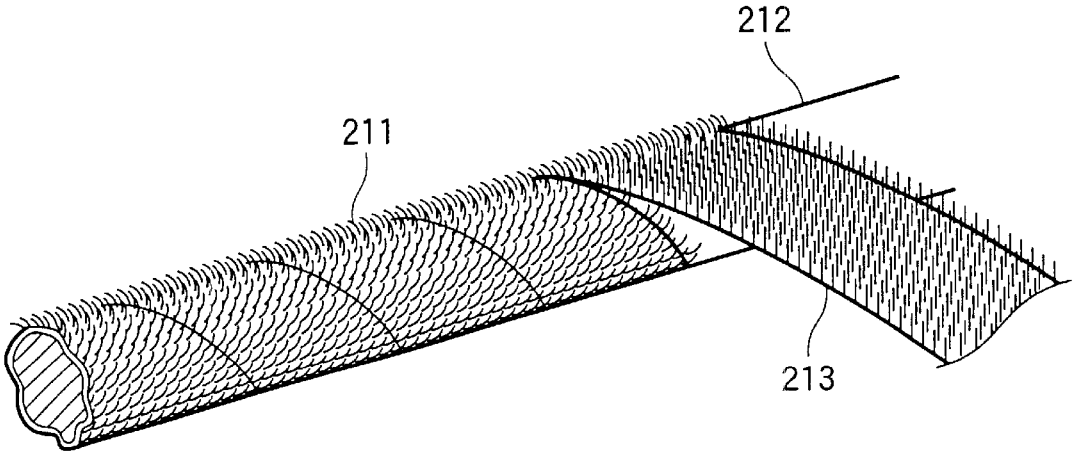
FIG. 3 is a perspective view to show a manufacturing method of the first brush roll.
Figure 4:
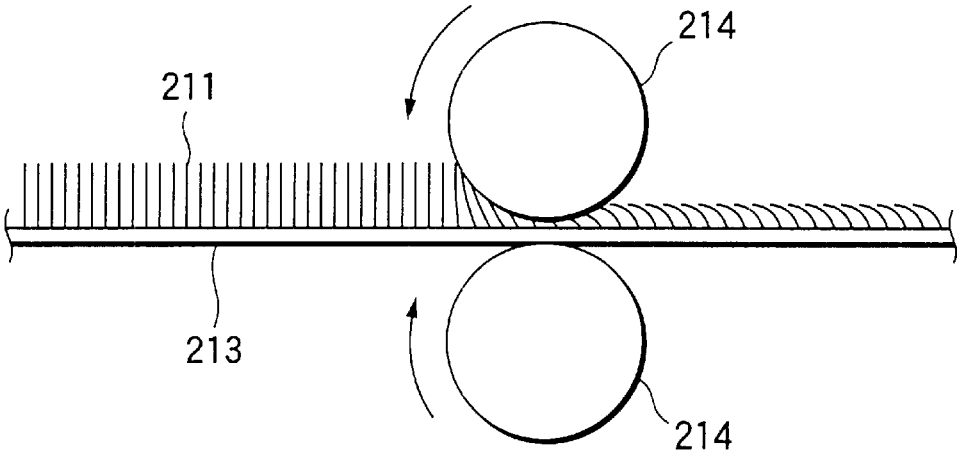
FIG. 4 is an enlarged sectional view to show a cloth with slidingly scrubbing bristles upright.

FIGS. 3 and 4 show an example of a manufacturing method of the first brush roll 215. As shown in FIG. 3, the first brush roll 215 is manufactured by winding a cloth 213 with slidingly scrubbing bristles 211 of conductive fiber upright around a conductive metal rotation shaft 212 spirally. The slidingly scrubbing bristles 211 are upright on the cloth 213 as shown in FIG. 4 and are sandwiched between heat rolls 214 and are pressurized, whereby the cloth 213 can be provided with the slidingly scrubbing bristles 211 lying down. The cloth 213 with the slidingly scrubbing bristles 211 lying down is wound around the rotation shaft 212, whereby the brush roll 215 with the slidingly scrubbing bristles 211 inclined in the circumferential direction can be manufactured.

As another manufacturing method, without laying down the slidingly scrubbing bristles at a stage before winding the cloth around the rotation shaft, a cloth with slidingly scrubbing bristles roughly perpendicularly upright is wound around a rotation shaft to form a brush roll and then the brush roll is rotated while it is pressed against a heat roll, whereby the slidingly scrubbing bristles can also be inclined in the circumferential direction. Further, in each manufacturing step of a cloth with slidingly scrubbing bristles upright, the slidingly scrubbing bristles may be laid down without considering raising of the slidingly scrubbing bristles.

Each of the second and third brush rolls can also be manufactured like the first brush roll.

In the cleaning unit according to the invention, the slidingly scrubbing bristles 211 of the brush roll 215 may be upright roughly perpendicularly to the periphery of the rotation shaft 212. Only the tips of the slidingly scrubbing bristles 211 maybe laid down in the circumferential direction. In this case, the brush roll 215 can be manufactured by making slidingly scrubbing bristles 211 upright roughly perpendicularly in relation to the periphery of a rotation shaft 212 and then laying down only the tips of the slidingly scrubbing bristles 211 in a specific direction while heat is applied.

In the cleaning unit according to the invention, the slidingly scrubbing bristles 211 of the brush roll 215 may be upright in a state in which the slidingly scrubbing bristles 211 are inclined in relation to the periphery of the rotation shaft 212.

In the cleaning unit according to the invention, the linear speed ratio of the brush roll to the rotation body at a contact position therebetween is preferably in a range of not more than 0.6 or a range of not less than 1.3. In this case, the toner deposited on the rotation body can be captured effectively and the remaining toner deposited on the rotation body does not adversely affect the image formation operation.

When the rotation speed ratio of the brush roll to the rotation body is about 1 in the linear speed ratio at a contact position therebetween, in other words, the rotation speed of the brush roll is approximately equal to that of the rotation body, the cleaning performance of the brush roll for cleaning the toner on a surface of the rotation body is low and thus it is not practical. The cleaning performance increases as the linear speed ratio is getting away from 1. In an experiment, when the linear speed of the brush roll was different from that of the rotation body by not less than about 20%, the cleaning performance apparently increased. The inclination of the slidingly scrubbing bristles of the brush roll varies widely. Therefore, when the brush roll of which the slidingly scrubbing bristles are upright roughly perpendicularly, the linear speed ratio varies in a range of from 0.7 to 1.2 and cannot be controlled. Accordingly, to obtain stable cleaning performance, it is effective that linear speed ratio is not more than 0.6 or not less than 1.3.

Obtaining by experiment, the linear speed ratio, which can be controlled by the inclination of the slidingly scrubbing bristles of the brush roll, was in a range of from about 0.3 to about 1.8. When the linear speed ratio was less than about 0.3, the brush roll performed defective rotation. When the linear speed ratio was more than 1.8, a problem in maintenance of a surface of the rotation body and the brush roll occurred. In the example of the brush roll for the photoconductor drum, when the linear speed ratio is about 0.4, the cleaning apparatus, which is the most effective (including the maintaining performance) as a whole of apparatus, can be obtained. In the example of the brush roll for the intermediate transfer drum, when the linear speed ratio is about 1.3, the cleaning apparatus, which is the most effective (including the maintaining performance) as a whole of apparatus, can be obtained.

As described above, according to the cleaning unit of the invention, the tips of the slidingly scrubbing bristles of the brush roll are inclined in the circumferential direction, whereby the linear speed of the brush roll can be made different from that of the rotation body although the brush roll is rotated with rotation of the rotation body. Thus, the cleaning unit of the invention enables the toner deposited on the rotation body to be efficiently captured without comprising a drive mechanism such as a motor, can contribute to miniaturization and cost reduction of an image formation apparatus, and makes it possible to suppress damage to the rotation body such as the photoconductor drum for prolonging the life of the image formation apparatus.

What is claimed is:

1. A cleaning unit comprising a brush roll having a large number of slidingly scrubbing bristles upright in relation to a rotation shaft thereof, the brush for slidingly scrubbing a surface of a rotation body with the brush roll to remove a toner deposited on the rotation body, wherein when the brush roll is out of contact with the rotation body, tips of the slidingly scrubbing bristles are inclined in a circumferential direction thereof; and wherein when the brush roll is in contact with the rotation body, the brush roll does not drive to rotate itself and is rotated to follow rotation of the rotation body; and wherein linear speed of the brush roll at a contact position between the brush roll and the rotation body is different from that of the rotation body at the contact position.

2. The cleaning unit according to claim 1, wherein the slidingly scrubbing bristles of the brush roll are upright roughly perpendicularly to the periphery of the rotation shaft; and wherein only the tips of the slidingly scrubbing bristles are laid down in the circumferential direction.

3. The cleaning unit according to claim 1, wherein the slidingly scrubbing bristles of the brush roll are upright in a state in which the slidingly scrubbing bristles are inclined in relation to the periphery of the rotation shaft.

4. The cleaning unit according to claim 3, wherein the brush roll comprises a cloth having slidingly scrubbing bristles upright, the cloth wound around the rotation shaft thereof; and wherein the slidingly scrubbing bristles are upright in an inclined state in relation to the cloth.

5. The cleaning unit according to claim 1, wherein the rotation shaft and the slidingly scrubbing bristles of the brush roll are conductive; and wherein a cleaning bias is applied between the brush roll and the rotation body.

6. The cleaning unit according to claim 1, wherein linear speed ratio of the brush roll to the rotation body at a contact position therebetween is in one of a range of not more than 0.6 and a range of not less than 1.3.

7. An image formation apparatus comprising:

a rotation body;

a first cleaning unit including a brush roll having a large number of slidingly scrubbing bristles upright in relation to a rotation shaft thereof, the brush for slidingly scrubbing a surface of the rotation body with the brush roll to remove a toner deposited on the rotation body; and a second cleaning unit, wherein when the brush roll is out of contact with the rotation body, tips of the slidingly scrubbing bristles are inclined in a circumferential direction thereof; and wherein when the brush roll is in contact with the rotation body, the brush roll does not drive to rotate itself and is rotated to follow rotation of the rotation body;

wherein linear speed of the brush roll at a contact position between the brush roll and the rotation body is different from that of the rotation body at the contact position;

wherein the rotation shaft and the slidingly scrubbing bristles of the brush roll are conductive;

wherein a cleaning bias is applied between the brush roll and the rotation body;

wherein during image formation operation, the cleaning bias is applied between the brush roll and the rotation body for capturing toner from the rotation body to the brush roll;

wherein after completion of the image formation operation and between one image formation operation and another, a toner collection bias of an opposite polarity to the cleaning bias is applied between the brush roll and the rotation body for ejecting the captured toner from the brush roll to the rotation body; and wherein the second cleaning unit collects the captured toner.

* * * * *